US006895754B2

(12) United States Patent
Hara

(10) Patent No.: US 6,895,754 B2
(45) Date of Patent: May 24, 2005

(54) VEHICLE CONTROL SYSTEM

(75) Inventor: Junichiro Hara, Nakano-ku (JP)

(73) Assignee: Calsonic Kansei Corporation, Tokyo (JP)

( * ) Notice: Subject to any disclaimer, the term of this patent is extended or adjusted under 35 U.S.C. 154(b) by 94 days.

(21) Appl. No.: 10/611,887

(22) Filed: Jul. 3, 2003

(65) Prior Publication Data

US 2004/0093870 A1 May 20, 2004

(30) Foreign Application Priority Data

Apr. 7, 2002 (JP) ..... 2002-195644

(51) Int. Cl.[7] ..... F01B 21/04
(52) U.S. Cl. ..... 60/706; 60/716; 60/719
(58) Field of Search ..... 60/698, 706, 711, 60/716, 719

(56) References Cited

U.S. PATENT DOCUMENTS 5,528,901 A * 6/1996 Willis ..... 60/626
6,173,574 B1 * 1/2001 Obayashi et al. ..... 60/710
6,209,672 B1 * 4/2001 Severinsky ..... 180/65.2
6,216,465 B1 * 4/2001 Wakashiro et al. ..... 60/706

* cited by examiner

*Primary Examiner*—Hoang M. Nguyen
(74) *Attorney, Agent, or Firm*—Wenderoth, Lind & Ponack, L.L.P.

(57) ABSTRACT

A vehicle control system is capable of precisely estimating an auxiliary machine motive power without increasing a processing load of an engine control means. An engine ECU 13 is provided with a first auxiliary machine motive power estimating section 16, and an auxiliary machine ECU 15 is provided with a second auxiliary machine motive power estimating section 17 having higher estimation precision than that of the first auxiliary machine motive power estimating section 16. Torque estimated values Tcomp1 and Tcomp2 for an auxiliary machine 14 are obtained respectively by the first auxiliary machine motive power estimating section 16 and the second auxiliary machine motive power estimating section 17, and control of an engine 11 is performed based on these torque estimated values Tcomp1 and Tcomp2.

20 Claims, 6 Drawing Sheets

VEHICLE CONTROL SYSTEM

BACKGROUND OF THE INVENTION

1. Field of the Invention

The present invention belongs to a technical field of a vehicle control system that performs control of a vehicle based on an auxiliary machine motive power.

2. Description of the Related Art

Technology described in, for example, Japanese Patent Laid-open No. Hei-175517 is well known as a vehicle control system of this type. This prior publication discloses a technique for obtaining an intake pressure set value from a detected heat load to calculate a required driving torque for a variable displacement compressor, thereby using the calculated torque for controlling an engine.

Specifically, in this prior art, a heat load calculation means, a required driving torque calculation means for a compressor, and an idle-up control means are used for calculating a torque that is a motive power of an auxiliary machine, and this torque is used for idle control of an engine.

Incidentally, in the above-described prior art, it is presumable that the required driving torque calculation means for a compressor performs calculation processing by an electronic device, and specifically, this electronic device is conceivable to be an airconditioning control ECU or an engine control ECU. Further, although there is no electronic device specified for the idle-up control means either, it is conceivable to be an engine control ECU.

Specifically, when the torque calculation means is the airconditioning control ECU, it needs to communicate with the engine control ECU, and when the torque calculation means is the engine control ECU, it is conceivable that the torque calculation means performs an idle control, which is an engine control, by communicating signals within the engine control ECU.

Here, if the torque calculation means is located inside the engine control ECU, a processing routine for calculating the required driving torque is needed for processing inside the engine control ECU. Since the engine control is generally performed at quite high speed, in order to perform a processing routine with a long processing time in the engine control, a CPU (central processing unit) that is capable of processing at higher speed is required in the engine control ECU, which causes a problem of making the engine control ECU expensive.

Meanwhile, if the torque calculation means is located inside the airconditioning control ECU, the reliability of the airconditioning control ECU becomes relatively lower than that of the engine control ECU from a viewpoint of manufacturing cost reduction. Accordingly, in case of failure or malfunction of the airconditioning control ECU, false torque data are communicated to the engine control ECU. In other words, if the torque data are larger than true values, fuel efficiency of the engine decreases, or if the torque data are smaller than the true values, it can cause a phenomenon called engine stall, which causes a problem of increasing the danger in driving a vehicle.

SUMMARY OF THE INVENTION

The present invention is made in view of the above-described problems, and an object thereof is to provide a vehicle control system capable of more precisely estimating an auxiliary machine motive power without increasing a processing load of an engine control means.

In order to achieve the object stated above, a vehicle control system according to the present invention includes an engine as a main drive source of a vehicle, an engine control means configured to control the engine, an auxiliary machine that is directly or indirectly driven by the engine, and an auxiliary machine control means configured to control the auxiliary machine.

The vehicle control system is characterized in that, as means for estimating a physical quantity related to a motive power of the auxiliary machine, the engine control means includes a first auxiliary machine motive power estimating section, and the auxiliary machine control means includes a second auxiliary machine motive power estimating section. Estimation precision of an auxiliary machine motive power estimated by the second auxiliary machine motive power estimating section is set higher than an estimation precision of an auxiliary machine motive power estimated by the first auxiliary machine motive power estimating section.

In the vehicle control system above, the engine control means sends an estimation condition to the auxiliary machine control means, and the auxiliary machine control means estimates the auxiliary machine motive power based on the estimation condition by the second auxiliary machine motive power estimating section and sends an estimated value to the engine control means.

The estimation condition is at least one of a response delay time, an estimation timing, and an estimation precision of the auxiliary machine motive power estimation.

The engine control means estimates the auxiliary machine motive power by the first auxiliary machine motive power estimating section when the second auxiliary machine motive power estimating section does not satisfy at least one of the estimation conditions.

A vehicle control system above further includes an estimated motive power deviation monitoring means configured to calculate a deviation between the auxiliary machine motive powers that are respectively estimated by the first auxiliary machine motive power estimating section and the second auxiliary machine motive power estimating section and to monitor whether the deviation is equal to or larger than a predetermined value. The engine control means estimates the auxiliary machine motive power by the first auxiliary machine motive power estimating section when the deviation becomes equal to or larger than the predetermined value.

The engine control means judges that the second auxiliary machine motive power estimating section is in failure when the deviation continues for a predetermined time or longer, at a predetermined frequency or more, or a predetermined number of times or more.

The engine control means corrects the auxiliary machine motive power estimated by the second auxiliary machine motive power estimating section when the deviation is larger than a first predetermined value and is smaller than a second predetermined value that is larger than the first predetermined value.

The deviation is compared under a predetermined condition.

In the vehicle control system above, the estimated motive power is used for at least one of an engine control, a transmission control, and an auxiliary machine control.

In the vehicle control system above, the auxiliary machine is at least one of an airconditioning compressor whose refrigerant discharge rate per one rotation is allowed to be set by an external signal, an airconditioning compressor whose rotation speed is allowed to be set by an external signal, a power generating alternator whose power generation rate is allowed to be set by an external signal, an engine cooling fan whose rotation speed is allowed to be set by an external signal, an engine cooling fan whose air flow rate is allowed to be set by an external signal, a cooling water pump whose rotation speed is allowed to be set by an external signal, a cooling water pump whose water flow rate is allowed to be set by an external signal, and an auxiliary water pump for a heater whose water flow rate is allowed to be set by an external signal.

In the invention, as the auxiliary machine motive power estimating means, the engine control means includes the first auxiliary machine motive power estimating section and the auxiliary machine control means includes the second auxiliary machine motive power estimating section. Auxiliary machine motive power is obtained at least by the two auxiliary machine motive power estimating means. Therefore, as compared with the prior art, the auxiliary machine motive power can be estimated more precisely, and by applying this invention to controlling an engine or the like, a fuel consumption amount can be improved.

Further, the estimation precision of the auxiliary machine motive power estimated by the second auxiliary machine motive power estimating section is set higher than the estimation precision of the auxiliary machine motive power estimated by the first auxiliary machine motive power estimating section, so that a calculating load of the engine control means can be suppressed too low load. Therefore, the cost of calculation means such as a microcomputer that is used as the engine control means can be reduced as compared with the prior system in which an auxiliary machine motive power estimating means is included only in an engine control means.

Meanwhile, by using the two auxiliary machine motive power estimating means, a decrease of fuel efficiency, an engine stall and so forth attributed to failure or malfunction of the auxiliary machine motive power estimating means can be avoided, so that reliability of control can be increased as compared with the prior system in which an auxiliary machine motive power estimating means is included only in an auxiliary machine control means.

A more precise auxiliary machine motive power can be estimated by a required condition by presenting the estimation condition of the auxiliary machine motive power from the engine control means to the auxiliary machine control means. Therefore, when the estimated auxiliary machine motive power is used for controlling an engine or the like, the fuel efficiency, motive power performance or the like of a vehicle can be improved.

The response delay time, the estimation timing, the estimation precision or the like is set as the condition. Accordingly, when the condition is the estimation timing for example, a timing when the engine control means requires an estimated auxiliary machine motive power is clearly indicated, so that the engine or the like can be more precisely controlled based on the estimated auxiliary machine motive power.

When the estimation condition is not satisfied, an auxiliary machine motive power is estimated not by the second auxiliary machine motive power estimating section, but by the first auxiliary machine motive power estimating section. Accordingly, when the first auxiliary machine motive power estimating section is not able to output the estimated auxiliary machine motive power for some kind of reason, although the precision is lower than that of the estimation by the first auxiliary machine motive power estimating section, a control precision can be increased as compared with a case of not performing the estimation of the auxiliary machine motive power.

The auxiliary machine motive power estimated by the first auxiliary machine motive power estimating section is compared with the auxiliary machine motive power estimated by the second auxiliary machine motive power estimating section. Subsequently, when a difference (deviation) between both the auxiliary machine motive powers is large, the auxiliary machine motive power is estimated by the first auxiliary machine motive power estimating section. Therefore, for the auxiliary machine control means, it is not necessary to use highly durable parts as those in the engine control means, so that the system can be constructed with low cost.

In the invention according above, it is judged that the auxiliary machine control means is in failure when the deviation continues for the predetermined time or longer, at the predetermined frequency or more, or the predetermined number of times or more. Therefore, the second auxiliary machine motive power estimating section that has a possibility of failure is not used, and the auxiliary machine motive power is estimated by the first auxiliary machine motive power estimating section, so that proper control can be performed even when the auxiliary machine control means is in failure.

When the deviation is not relatively large, it is not judged as failure but as "discrepancy" from a correct value due to various types of errors, and the auxiliary machine motive power estimated by the second auxiliary machine motive power estimating section is corrected. Further, as a condition to compare the deviation, the deviation is compared under a predetermined condition, so that a judgment precision of the deviation is increased.

Specifically, when the deviation is within a predetermined range and is not large enough to be judged as failure, it can be judged that the deviation is caused by a deterioration over time or the like of the detection precision of a sensor, so that the auxiliary machine motive power estimated by the second auxiliary machine motive power estimating section can be corrected appropriately to be used. Accordingly, an effect of the deterioration over time can be readily apprehended quantitively, the deviation is used for calculating a correction amount for a variation over time or the like in a state that a use condition is relatively stable, and the auxiliary machine motive power is corrected by the correction amount, so that a torque estimation precision by the second auxiliary motive power estimating section can be improved.

The application fields of the above-described method for a motive power estimation, can be used for controlling an engine, transmission or the like of a vehicle by an auxiliary machine motive power. Also, the invention describes, as the auxiliary machine, auxiliary machines capable of changing required motive powers by external signals.

Specifically, an auxiliary machine whose auxiliary machine load is allowed to be set by an external signal is selected as the auxiliary machine, a motive power estimated by the auxiliary machine motive power estimating means is used for controlling an engine, a transmission and so forth, and the setting of motive power of the auxiliary machine is changed according to a request from the engine, the transmission or the like, so that characteristics of the engine or transmission can be improved, and therefore the fuel consumption amount and the like can be improved.

DETAILED DESCRIPTION OF THE PREFERRED EMBODIMENTS

Hereinafter, embodiments of the present invention will be explained based on the drawings.

(Embodiment 1)

Figure 1:
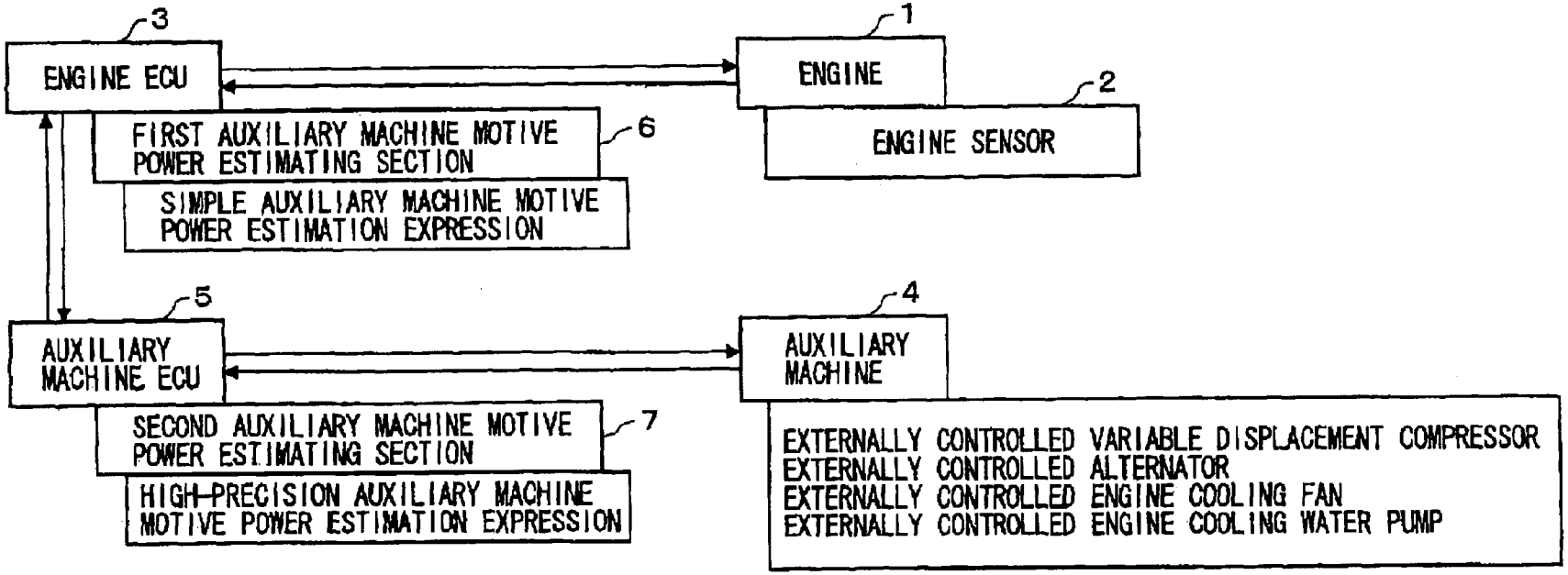
FIG. 1 is a block diagram showing a vehicle control system of an embodiment 1.

FIG. 1 is a block diagram showing a vehicle control system of the embodiment 1.

An engine 1 is provided with plural engine sensors 2, and the engine 1 is controlled by an engine ECU (electrical control unit) 3. There is also provided an auxiliary machine 4 that is directly or indirectly driven by the engine 1 such as an externally controlled variable displacement compressor or the like, and this auxiliary machine 4 is controlled by an auxiliary machine ECU 5. Then, communication is conducted between the auxiliary machine ECU 5 and the engine ECU 3 for controlling the engine 1 and the auxiliary machine 4.

The engine ECU 3 includes a first auxiliary machine motive power estimating section 6, and the auxiliary machine ECU 5 includes a second auxiliary machine motive power estimating section 7. The engine ECU 3 detects a status of the auxiliary machine 4 by a sensor on the auxiliary machine 4 side, or a set value of the auxiliary machine 4 is instructed from the auxiliary machine ECU 5. Then, the auxiliary machine status detected by the sensor or the set value of the auxiliary machine 4 is used to estimate a physical quantity related to a motive power of the auxiliary machine 4. For example, a torque of a compressor using discharge pressure data of an airconditioning refrigeration cycle including the compressor is estimated. This estimation is performed by two auxiliary machine motive power estimating means, the first auxiliary machine motive power estimating section 6 and the second auxiliary machine motive power estimating section 7.

Since the engine ECU 3 generally controls the engine 1 at high speed, one cycle of the control is quite short, so that a torque estimation of such a compressor is performed using a simple mathematical expression. Also, the auxiliary machine ECU 5 controls the auxiliary machine 4, but a response of the auxiliary machine 4 is relatively slow. For example, even when a rotation speed of an externally controllable engine cooling water pump is changed, the water temperature of the engine 1 changes slowly. Accordingly, a control cycle of the auxiliary machine ECU 5 is much longer than that of the engine ECU 3. Specifically, the engine ECU 3 performs the control by a short cycle such as 3 ms (milliseconds) at the maximum, whereas the auxiliary machine ECU 5 can adequately control the auxiliary machine 4 by a cycle of approximately 50 ms. Therefore, for example, when estimating a torque of a compressor, estimation expressions according to various types of conditions can be used separately, which makes it possible to perform an estimation with high precision by more complicated calculation expressions. Thus, the first auxiliary machine motive power estimating section 6 is configured to estimate an auxiliary machine motive power based on a simple auxiliary machine motive power estimation expression that is a simple calculation expression, while the second auxiliary machine motive power estimating section 7 is configured to estimate an auxiliary machine motive power based on a high precision auxiliary machine motive power estimation expression that is a complicated calculation expression.

When the control using a motive power of the auxiliary machine 4 is performed by the engine ECU 3, the estimation control of an auxiliary machine motive power is improved by instructing a target condition to the auxiliary machine ECU 5 side. For example, a vehicle is in a state that it turns from a normal running state to a speed reduction state just before it turns to a so-called vehicle idle state, in which the vehicle is stopped but the engine 1 is still running. For controlling an engine, when a required load during idling such as a torque of the above-described compressor for example is given, an idle rotation speed of the engine 1 can be set more properly, so that fuel efficiency, vibration, noise and so forth can be improved. In other words, setting the idle rotation speed of the engine 1 as low as possible is effective to improve the fuel efficiency. However, when the engine rotation speed is too low as against an engine load torque for keeping the idle state, it increases a possibility of the engine 1 to stall and stop, that is, a so-called engine stall. Here, if the time taken for the engine 1 to turn to the idle state is estimated just before the idle state, and a motive power of the auxiliary machine during idling can be estimated within this time, the idle rotation speed of the engine 1 can be precisely determined.

Further, to precisely carry out the auxiliary machine motive power estimation, at least one condition of a delay time for the auxiliary machine ECU 5 to respond to the engine ECU 3, an estimation timing, an estimation precision or the like is instructed as the target condition from the engine ECU 3 side to the auxiliary machine ECU 5 side.

When the second auxiliary machine motive power estimating section 7 of the auxiliary machine ECU 5 does not satisfy the above-described condition, a signal indicating the dissatisfaction is sent from the auxiliary machine ECU 5 to the engine ECU 3 side, and an auxiliary machine motive power is estimated by the first auxiliary machine motive power estimating section 6 of the engine ECU 3. For example, when a speed reduction time is so short that there is little time for estimating the torque of a compressor under a vehicle idle state, the torque is estimated not by using the second auxiliary machine motive power estimating section 7, but by using the first auxiliary machine motive power estimating section 6.

Accordingly, the torque estimation precision decreases, and generally, as compared to a case using a torque value with high precision, a rotation speed during idling increases and fuel efficiency decreases. However, the precision is better than a case without performing the torque estimation. Specifically, when decreasing speed, if the time until reaching an idle state is long enough, the auxiliary machine motive power is estimated by the second auxiliary machine motive power estimating section 7. Meanwhile, if the time until reaching the idle state is quite short, the auxiliary machine motive power is estimated by the first auxiliary machine motive power estimating section 6. Therefore, the fuel efficiency can be improved under various running conditions.

(Embodiment 2)

Figure 2:
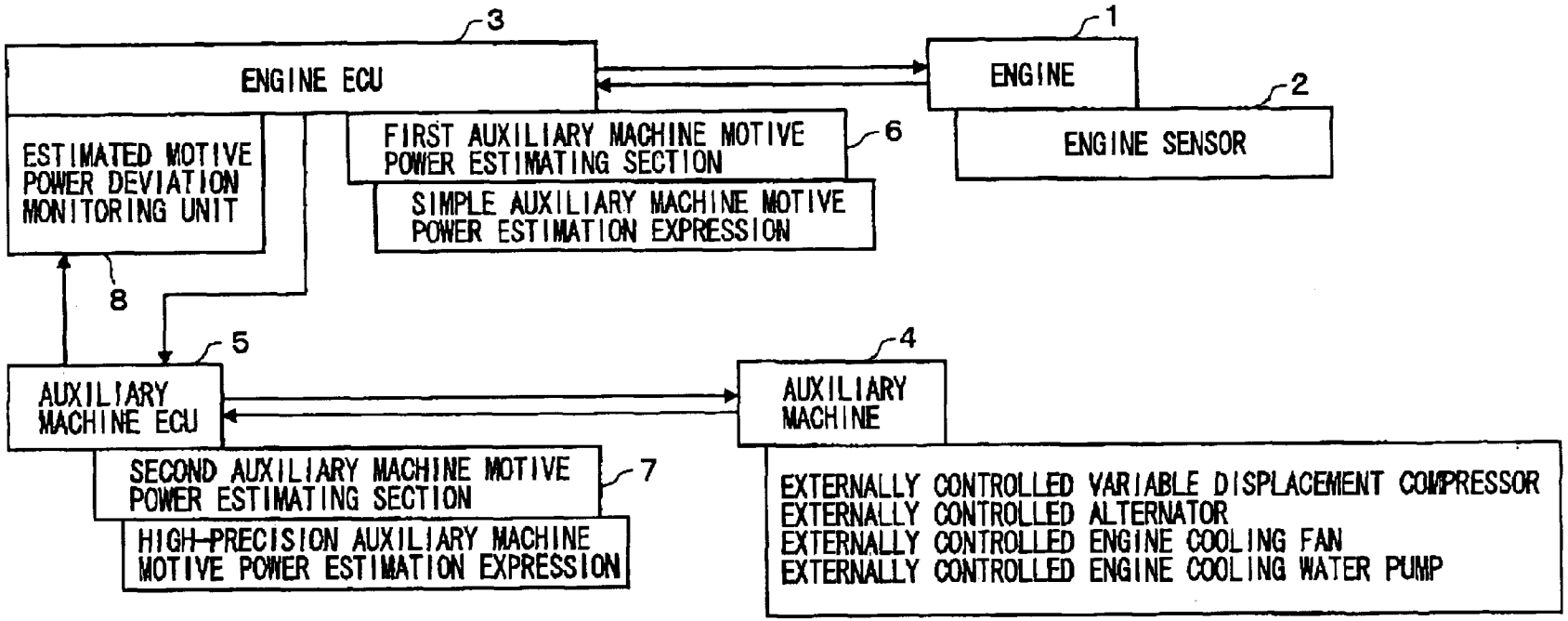
FIG. 2 is a block diagram showing a vehicle control system of an embodiment 2.

FIG. 2 is a block diagram showing a vehicle control system of the embodiment 2. Note that the configuration of the embodiment 2 is different from the embodiment 1 in that the engine ECU 3 includes an estimated motive power deviation monitoring means 8. Since the remaining configuration is the same as that of the embodiment 1, further explanation thereof will be omitted.

The engine ECU 3 compares an auxiliary machine motive power estimated value estimated by the first auxiliary machine motive power estimating section 6 with an auxiliary machine motive power estimated value estimated by the second auxiliary machine motive power estimating section 7. Then, the deviation thereof is calculated by the estimated motive power deviation monitoring means 8 located in the engine ECU 3 and is compared with a predetermined value. Accordingly, it becomes possible to readily detect whether the second auxiliary machine motive power estimating means 7 located in the auxiliary machine ECU 5 is in failure or not.

Specifically, as compared with the engine ECU 3, the auxiliary machine ECU 5 has a smaller calculation processing amount and causes a relatively small effect on driving a vehicle even in case of failure, so that it is generally manufactured with low cost. Accordingly, the auxiliary machine ECU 5 has a lower reliability as compared to that of the engine ECU 3. Therefore, by checking a degree of the deviation of the motive power estimated values using the engine ECU 3, whether the auxiliary machine ECU 5 is in failure or not can be judged.

Incidentally, it may be judged that the engine ECU is in failure when the deviation continues for a predetermined time or longer, a predetermined frequency or more, or a predetermined number of times or more.

Here, when the deviation exists but is larger than a first set value and is smaller than a second set value that is larger than the first set value, the state of the auxiliary machine ECU 5 can be detected not as failure, but as displacement from an initial running state by a variation over time of a sensor or the like. Therefore, by appropriately adding a correction amount to the auxiliary machine motive power estimated value that is estimated by the second auxiliary machine motive power estimating section 7, the more precise estimation of the auxiliary machine motive power becomes possible.

Further, when the deviation exists, a condition for measuring a deviation amount can be specified to precisely calculate the deviation amount and to more precisely set the above-described correction amount. For example, the deviation is recorded when the control of the engine 1 or a not shown transmission is relatively stable, such as while running on a flat road at constant speed. Then, this record database can be used for, or output from the second auxiliary machine motive power estimating part 7 of the auxiliary machine ECU 5 is recorded and this record database can be used for obtaining a variation amount over time of the second auxiliary machine motive power estimating section 7. In addition, even when the same condition cannot be precisely set, if the measurements are performed under plural conditions, the resultant data can be easily read as a deviation under a certain specific condition by correlating or interpolating these data.

Next, examples will be explained.

(First Example)

First, the configuration will be explained.

Figure 3:
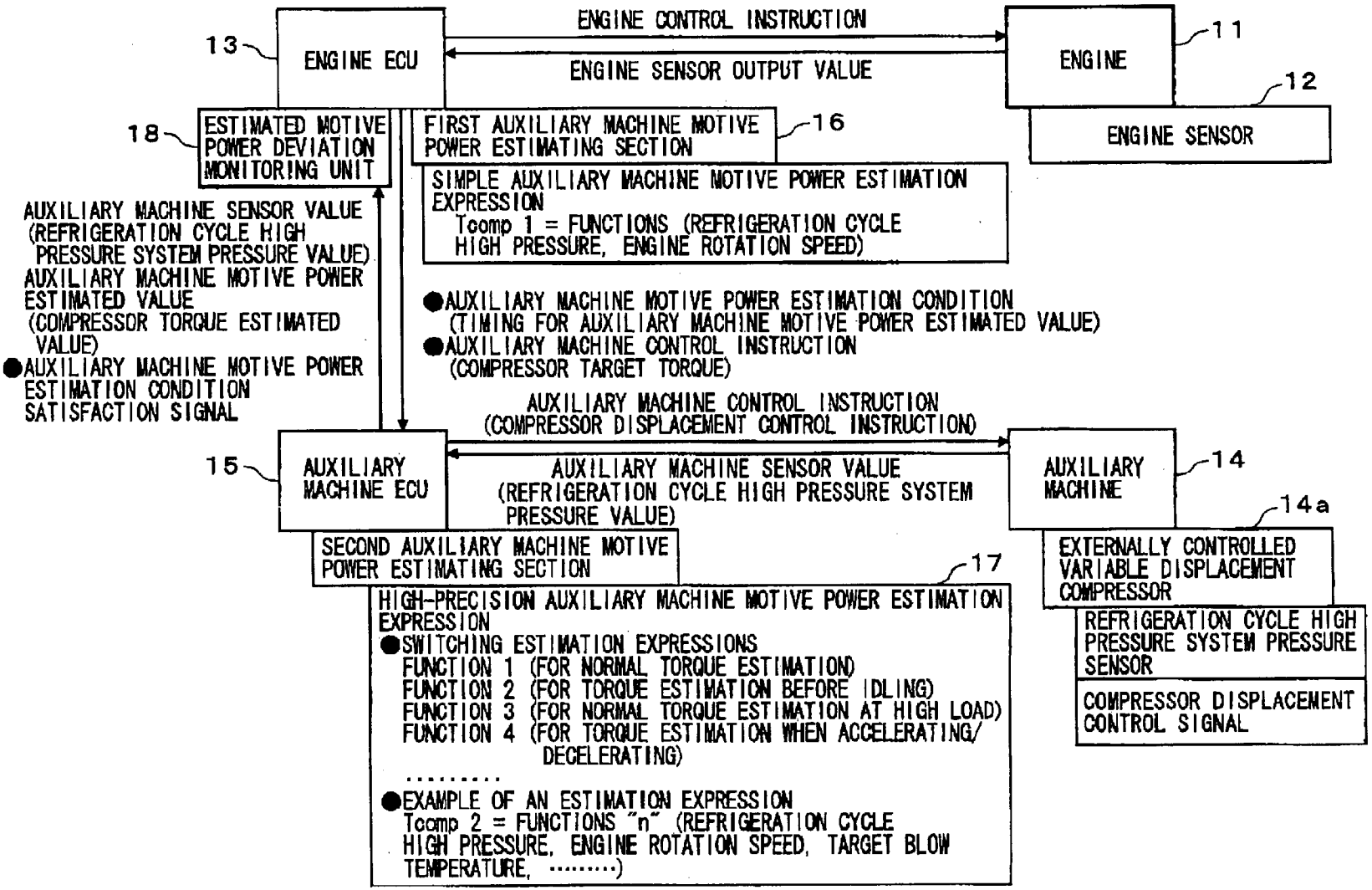
FIG. 3 is a whole system diagram showing a vehicle control system of a first example.

FIG. 3 is a whole system diagram showing a vehicle control system of a first example.

An engine 11 is provided with an engine sensor 12, and communication is conducted between the engine 11 and an engine ECU (electrical control unit) 13. Specifically, the engine 11 outputs a signal of the engine sensor 12 to the engine ECU 13, and the engine ECU 13 outputs an engine control instruction to the engine 11.

Next, while there are several types of an auxiliary machine 14, in this example, an externally controlled variable displacement compressor (compressor) 14*a* will be explained as an example, whose refrigerant discharge rate per one rotation can be set by an external signal. A refrigeration cycle including this compressor 14*a* has a pressure sensor for measuring a pressure of a high pressure system of the refrigeration cycle. Further, to this compressor 14*a*, a signal for controlling a displacement (refrigerant discharge rate per one rotation) is inputted.

The compressor 14*a* is driven by the engine 11 and changes a refrigerant of low temperature, low pressure gas sent from a not-shown evaporator to a high temperature, high pressure gas and sends it to a not-shown condenser. In this compressor 14*a*, a compressor discharge displacement is variably controlled externally by a duty signal to an internal control valve.

Figure 4:
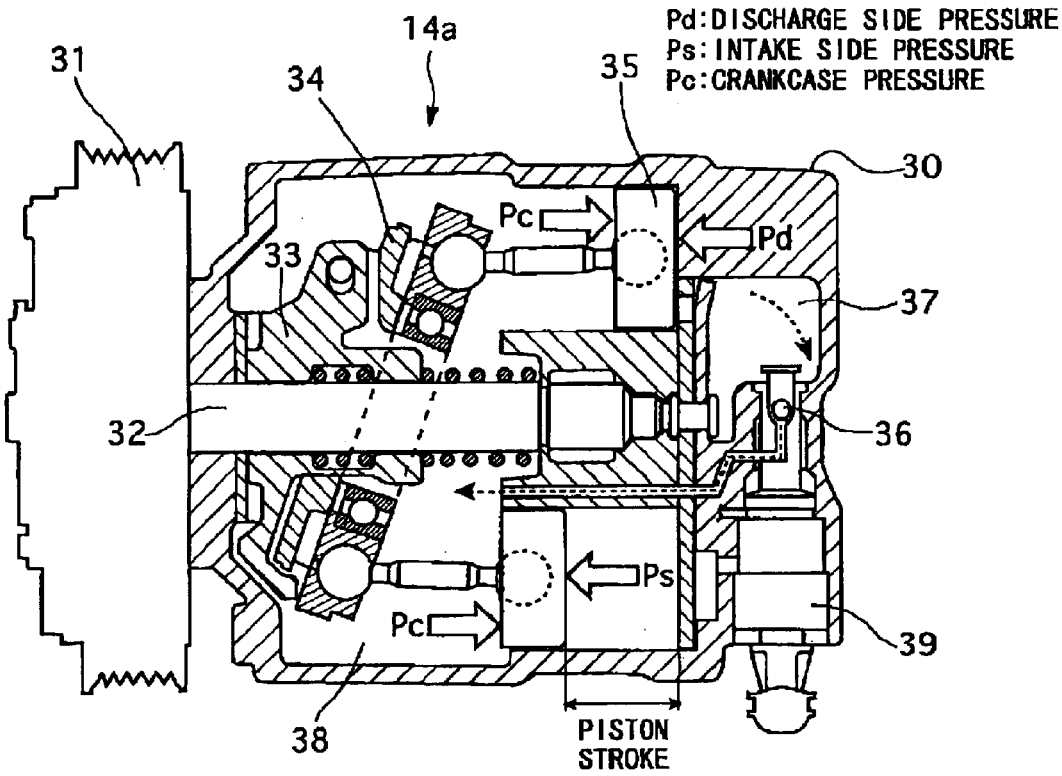
FIG. 4 is a cross-sectional view showing an externally controlled variable displacement compressor.
Figure 5:
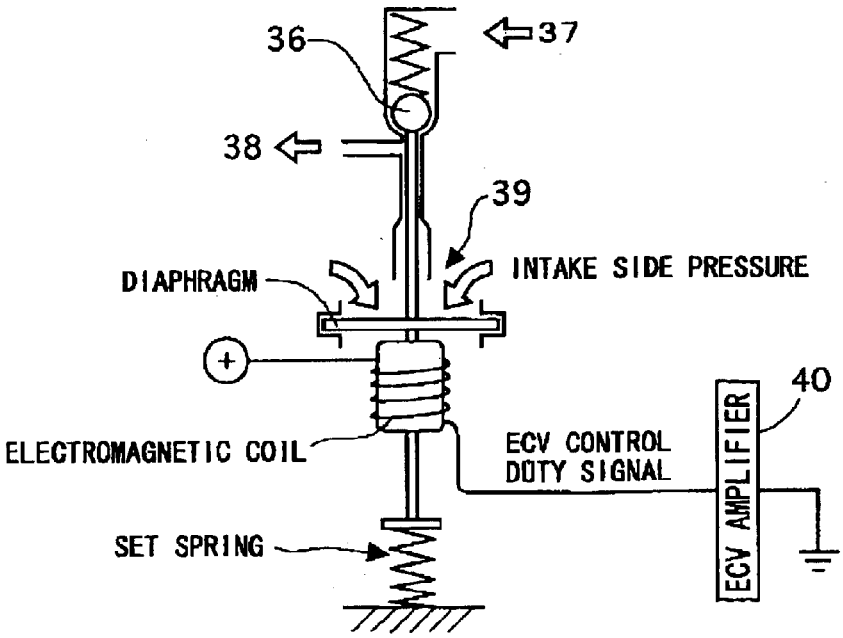
FIG. 5 is an explanatory diagram showing the operation of controlling a compressor discharge displacement (discharge side pressure) by a duty signal to a control valve of a compressor.

FIG. 4 is a cross-sectional view showing the externally controlled variable displacement compressor 14*a*, and FIG. 5 is an explanatory diagram showing the operation of controlling a compressor discharge displacement (discharge side pressure) by the duty signal to the control valve of the compressor 14*a*.

The compressor 14*a* is a multi-cylinder, swash plate type having a compressor case 30, a pulley 31, a drive shaft 32, a swash plate drive body 33, a swash plate 34, a piston 35, a high pressure ball valve 36, a high pressure chamber 37, a crankcase 38, and a control valve 39.

This compressor 14*a* controls a discharge displacement by changing an angle of the built-in swash plate 34. Specifically, by the duty signal to the control valve 39 assembled in the compressor 14*a*, a lift amount of the high pressure ball valve 36 is changed. Accordingly, a refrigerant flow rate to flow from the high pressure chamber 37 (=discharge side pressure Pd) through the high pressure ball valve 36 into the crankcase 38 is controlled, the pressure in the crankcase 38 (=crankcase pressure Pc) in the compressor 14*a* is changed, and the inclination of the swash plate 34 is changed.

The lift amount of the high pressure ball valve 36 is, as shown in FIG. 4, determined by a balance among a low pressure (=intake side pressure Ps) applied to a diaphragm of the control valve 39, the spring load of a set spring, and a magnetic force generated on an electromagnetic coil.

To the electromagnetic coil inside the control valve 39, a pulse signal ON-OFF signal of 400 Hz (duty signal) for example is sent from an ECV amplifier 40, and the change of a magnetic force generated by an effective current by a duty ratio is used for controlling the lift amount of the high pressure ball valve 36.

Returning to FIG. 3, the communication is conducted between the auxiliary machine 14 and the auxiliary machine ECU 15. The auxiliary machine ECU 15 outputs an auxiliary machine control instruction, a compressor displacement control instruction in this example, to the auxiliary machine 14, and the auxiliary machine 14 outputs a refrigeration cycle high pressure system pressure value as an output value of the auxiliary machine sensor to the auxiliary machine ECU 15.

Further, communication is also conducted between the engine ECU 13 and the auxiliary machine ECU 15, and the engine ECU 13 outputs to the auxiliary machine ECU 15 an estimation condition of an auxiliary machine motive power and a control instruction for the auxiliary machine. For example, as the estimation condition, an estimation timing of the auxiliary machine motive power is instructed, and as the control instruction for the auxiliary machine, a target value of the torque of the compressor 14*a* is instructed.

Here, in order for the engine ECU 13 to judge whether or not the estimation of auxiliary machine motive power is performed according to the designated estimation condition, the auxiliary machine ECU 15 outputs to the engine ECU 13 a signal indicating whether the estimation condition is satisfied or not. When the motive power estimation is performed by the designated estimation condition, the engine ECU 13 performs engine control using a motive power estimated value with high precision estimated by the second auxiliary machine motive power estimating section 17. Meanwhile, when the motive power estimation is not performed according to the designated estimation condition, the engine ECU 13 performs the engine control using a motive power estimated value estimated by the first auxiliary machine motive power estimating section 16.

As described later, the estimated motive power by the second auxiliary machine motive power estimating section 17 is a smaller value than the estimated motive power by the first auxiliary machine motive power estimating section 16. Accordingly, a fuel injection amount that corresponds to the load of the auxiliary machine motive power by the engine ECU 13 becomes smaller, and therefore, a fuel consumption amount improves. In other words, fuel efficiency improves.

The first auxiliary machine motive power estimating section 16 is contained in the engine ECU 13. Here, "contained" means that the program routine of the estimating means is described in a part of the control software of the engine ECU 13 configured by a microcomputer or the like. This estimating means includes an calculation expression (a simple auxiliary machine motive power estimation expression) program for estimating the torque as the motive power of the compressor 14*a*. As shown in the diagram, in this example, the pressure of the high pressure system of the refrigeration cycle and the engine rotation speed (in relation of constant multiple with the rotation speed of the compressor 14*a*) are used to estimate the torque of the compressor 14*a*, which is a physical quantity related to the motive power of the compressor 14*a*.

On the other hand, the second auxiliary machine motive power estimating section 17 is contained in the auxiliary machine ECU 15. This estimation means switches plural estimation expressions (high-precision auxiliary machine motive power estimation expressions) according to conditions, and uses the high pressure of the refrigeration cycle and so forth, as shown in the diagram, to estimate the torque of the compressor 14*a*, which is a physical quantity related to the motive power of the compressor 14*a*. As described above, the second auxiliary machine motive power estimating section 17 uses a more complicated calculation expression to obtain an estimation value with high precision, and is capable of estimating the auxiliary machine motive power with higher precision than the first auxiliary machine motive power estimating section 16.

To the engine ECU 13, the motive power estimated value estimated by the first auxiliary machine motive power estimating section 16 and the motive, power estimated value estimated by the second auxiliary machine motive power estimating section 17 are inputted. For the estimation of the auxiliary machine motive power by the first auxiliary machine motive power estimating section 16, a relatively simple calculation expression is used, which enables high speed processing but makes the precision low. Accordingly, the engine ECU 13 expects an error accompanying the estimation and then adds a tolerance value to the auxiliary machine motive power estimated value. This auxiliary machine motive power estimated value containing the tolerance value is larger than the motive power estimated value estimated by the second auxiliary machine motive power estimating section 17.

Further, the engine ECU 13 includes an estimated motive power deviation monitoring means 18. This estimated motive power deviation monitoring means 18 is a means for monitoring the deviation between the auxiliary machine motive powers respectively estimated by the first auxiliary machine motive power estimating section 16 and the second auxiliary machine motive power estimating section 17.

Next, the operation will be explained.

(Auxiliary machine motive power estimation control process)

Figure 6:
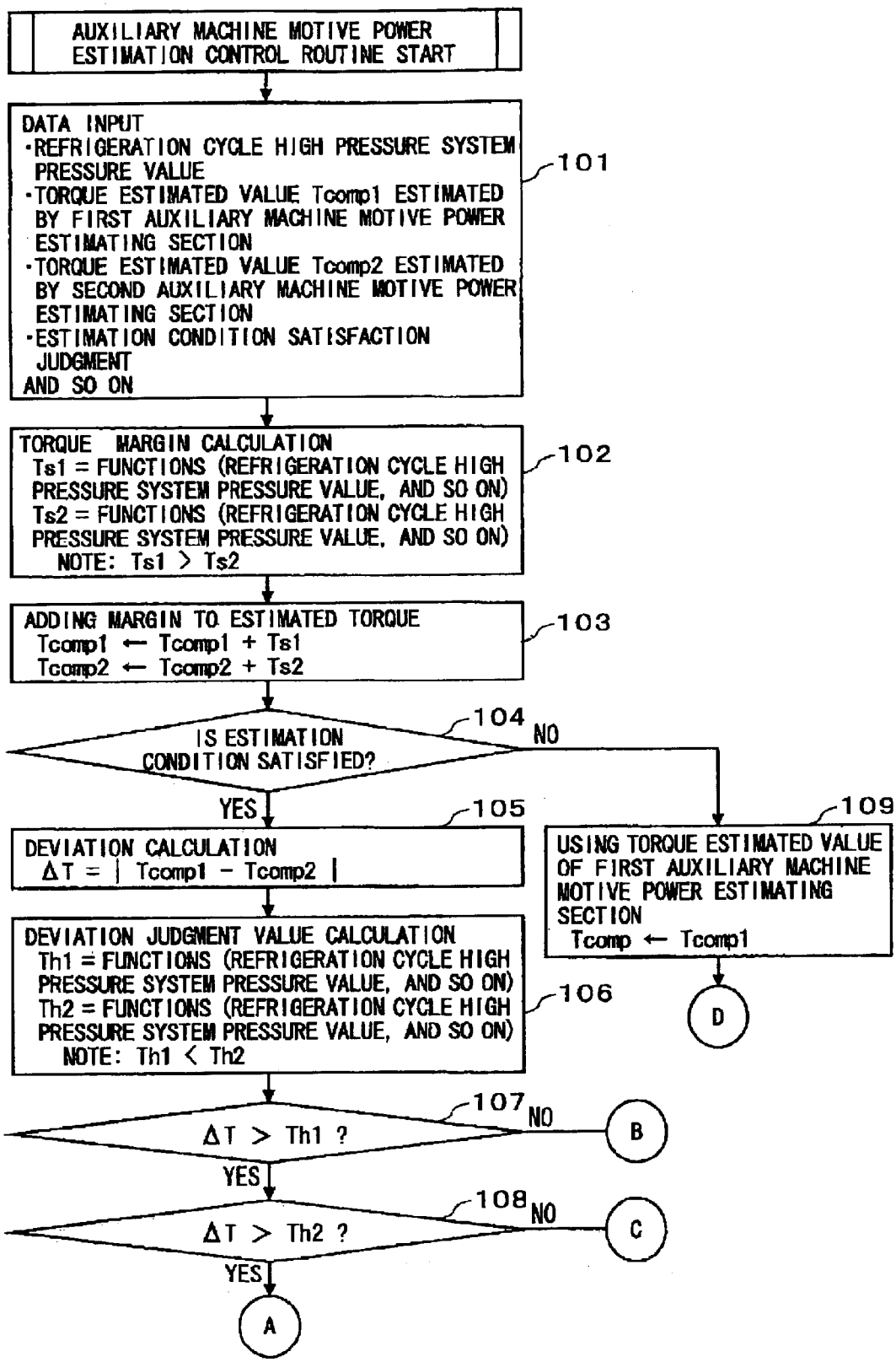
FIG. 6 is a flowchart showing the flow of a control process of an auxiliary machine motive power estimation in an engine ECU.
Figure 7:
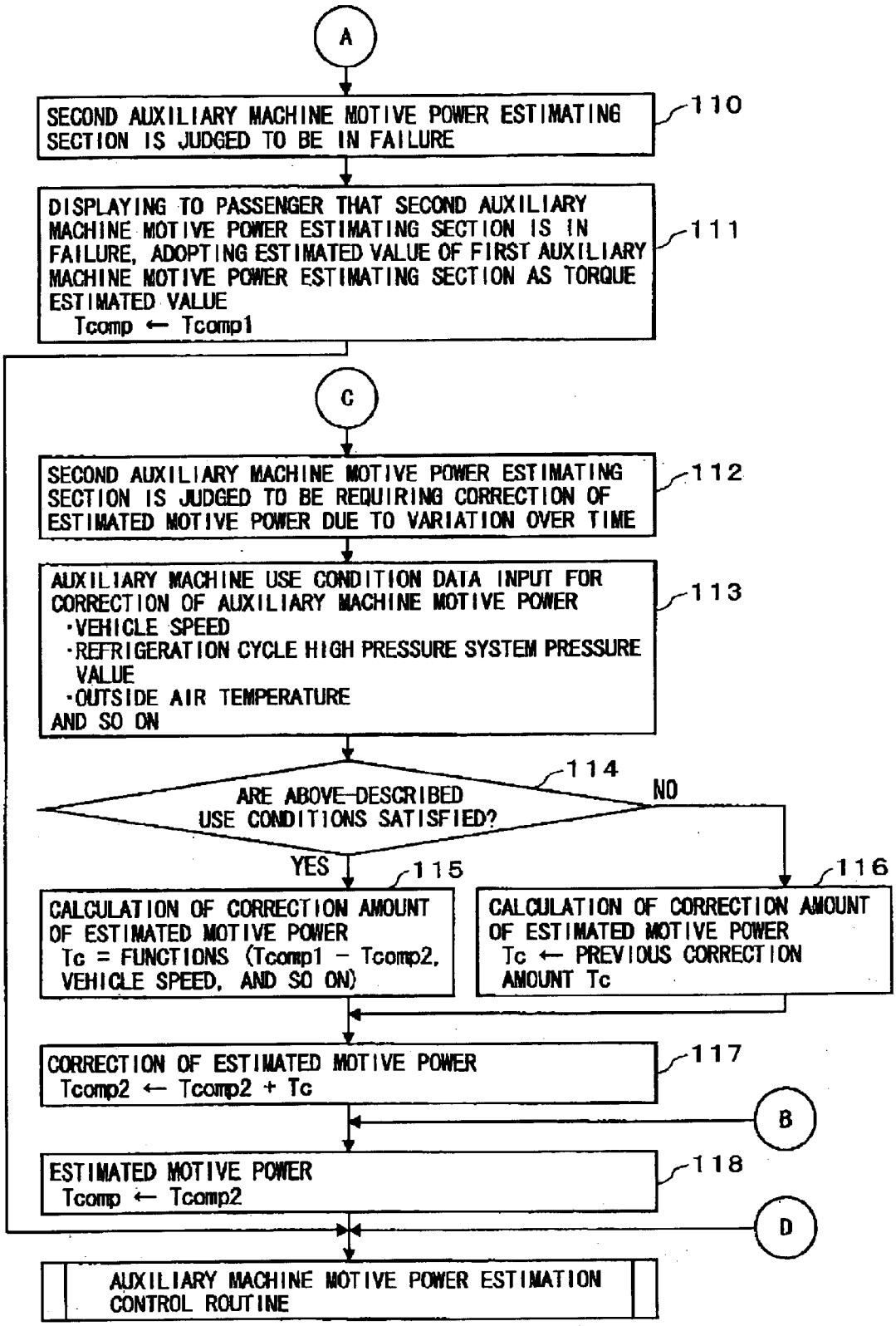
FIG. 7 is a flowchart showing the flow of the control process of the auxiliary machine motive power estimation in the engine ECU.

FIGS. 6 and 7 are flowcharts showing the flows of a control process of the auxiliary machine motive power estimation in the engine ECU 13 In Step 101, data such as a refrigeration cycle high pressure system pressure value, a torque estimated value Tcomp1 of the compressor 14*a* estimated by the first auxiliary machine motive power estimating section 16, a torque estimated value Tcomp2 of the compressor 14*a* estimated by the second auxiliary machine motive power estimating section 17, and an estimation condition satisfaction judgment and so forth are inputted.

In Step 102, torque margins Ts1 and Ts2 are calculated. These margins Ts1 and Ts2 are estimated largely in advance in expectation of an error in the estimated torque. In case the torque is estimated smaller than the actual torque, the margins Ts1 and Ts2 calculated there are added in order not to make the torque smaller than the actual torque. If the torque is estimated smaller than the actual torque under a condition, for example, that a vehicle is in an idle state and its engine rotation speed is quite low, the drive power of the engine 11 is so small that the motive power for the auxiliary machine 14 being insufficiently estimated can cause the engine 11 to stop, that is, a phenomenon called engine stall. The margins Ts1 and Ts2 are set to avoid this phenomenon. As a specific calculation method, the pressure value of the refrigeration cycle high pressure system or the like is used. Here, the margins Ts1 and Ts2 are set in such a manner that the margin Ts1 to be added to the torque estimated value estimated by the first auxiliary machine motive power estimating section 16 is set larger than the margin Ts2 to be added to the torque estimated value estimated by the second auxiliary machine motive power estimating section 17.

In Step 103, these margins Ts1 and Ts2 are added to the torque estimated values Tcomp1 and Tcomp2 to correct these estimated values, respectively. By this operation, the upper limits of the torques including errors of the calculated torque estimated values Tcomp1 and Tcomp2 can be estimated.

In Step 104, when the second auxiliary machine motive power estimating section 17 estimates the motive power, it is judged whether or not the estimation satisfies a designated condition. If the condition is not satisfied, the control proceeds to Step 109, adopts the torque estimated value Tcomp1 by the first auxiliary machine motive power estimating section 16, and is finished. Meanwhile, if the condition is satisfied, the control proceeds to Step 105.

In Step 105, a deviation $\Delta T$ between the two torque estimated values Tcomp1 and Tcomp2 is calculated.

In Step 106, deviation judgment values Th1 and Th2 are calculated for judging whether the deviation $\Delta T$ is correct or not. Generally, it is possible to fix the deviation judgment values. However, for more precise judgment under various conditions, the deviation judgment value adapted to each condition is calculated and used.

In Step 107, the deviation ΔT is compared with the first deviation judgment value Th1. When the deviation ΔT is equal to or smaller than the first deviation judgment value Th1, it is judged that the torque estimated value by the second auxiliary machine motive power estimating section 17 is correct, and the control proceeds to Step 118. Meanwhile, when the deviation ΔT is larger than the first deviation judgment value Th1, the control proceeds to Step 108.

In Step 108, the deviation ΔT is compared with the second deviation judgment value Th2 that is larger than the first deviation judgment value Th1. When the judgment value ΔT is equal to or smaller than the second deviation judgment value Th2, the control is finished. Meanwhile, when the deviation ΔT is larger than the second deviation judgment value Th2, the control proceeds to Step 110.

In Step 110, since the deviation ΔT is exceedingly large, it is judged that the second auxiliary machine motive power estimating section 17 is in failure.

In Step 111, this failure is displayed and notified to the passenger, and the torque estimated value by the first auxiliary machine motive power estimating section 16 in the engine ECU 13 is adopted.

In Step 112, it is judged that the second auxiliary machine motive power estimating section 17 needs to have a correction on the motive power estimation due to a variation over time.

In Step 113, for correcting the auxiliary machine motive power, auxiliary machine use renditions are inputted as data such as vehicle speed, a high pressure system pressure value of a refrigeration cycle, outside temperature and the like.

In Step 114, it is judged whether the auxiliary machine use condition is stable or not. When the use condition is judged to be stable, the control proceeds to Step 115, and when it is judged to be unstable, the control proceeds to Step 116.

In Step 115, a correction amount Tc of the estimated motive power is calculated.

In Step 116, the previous correction amount Tc is used as it is.

In Step 117, the correction amount Tc obtained in Step 115 or in Step 116 is added to the torque Tcomp2 to correct the estimated motive power.

In Step 118, the torque Tcomp2 is adopted as the torque Tcomp, and the control is finished.

Next, the effects will be explained.

In the vehicle control system in the first example, the following listed effects can be obtained.

(1) The deviation ΔT is calculated from the torque estimated values Tcomp1 and Tcomp2 of the compressor 14*a* respectively calculated by the first auxiliary machine motive power estimating section 16 and the second auxiliary machine motive power estimating section 17. When the deviation ΔT is equal to or smaller than the deviation judgment value Th1, the engine control is performed based on the torque estimated value Tcomp2 that is estimated by the second auxiliary machine motive power estimating section 17, so that a more precise torque estimation for the compressor 14*a* can be performed, thereby improving the fuel consumption amount of the engine 11.

(2) The margins Ts1 and Ts2 are added to the torque estimated values Tcomp1 and Tcomp2 respectively in order to estimate the upper limits of the torques including errors of the calculated torque estimated values Tcomp1 and Tcomp2, so that a more precise torque estimation can be performed.

(3) When obtaining the torque estimated value Tcomp2 by the second auxiliary machine motive power estimating section 17, it is judged whether the specified condition is satisfied or not, and when the condition is not satisfied, the torque estimated value Tcomp1 obtained by the first auxiliary machine motive power estimating section 16 is used for controlling the engine, so that when a motive power estimation is needed in shorter time than the processing routine of the auxiliary machine ECU 15, or even when the second auxiliary machine motive power estimating section 17 is in failure, the fuel consumption amount can be improved.

(4) When the deviation ΔT is larger than the margin Ts1 and is equal to or smaller than the margin Ts2, the torque estimated value Tcomp2 is corrected by adding the correction amount thereto, so that the torque estimation precision of the second auxiliary machine motive power estimating section 17 can be improved.

(5) When the deviation ΔT is larger than the margin Ts2 (>Ts1), the second auxiliary machine motive power estimating section 17 is judged to be in failure, and the torque estimated value Tcomp1 calculated by the first auxiliary machine motive power estimating section 16 is used for controlling the engine, so that the engine is controlled properly even when the auxiliary machine ECU 15 is in failure.

(Other Examples)

In the foregoing description, the vehicle control system of the present invention has been described based on the first example, but it is to be understood that the concrete configuration of the present invention is not limited to that of the first example, and various changes, additions and so forth of the design may be made without departing from the spirit of the inventions according to the claims.

For example, in the first example, only the torque estimation of the externally controlled variable displacement compressor 14*a* as the motive power estimation of the auxiliary machine 14 is explained as an example, but an externally controlled alternator, an externally controlled engine cooling fan, an externally controlled engine cooling water pump or the like may be used as the auxiliary machine 14, or a combination of these may be adopted as the configuration.

What is claimed is:

1. A vehicle control system, comprising:

an engine as a main drive source of a vehicle;

an engine control means configured to control said engine;

an auxiliary machine that is directly or indirectly driven by said engine; and an auxiliary machine control means configured to control said auxiliary machine, wherein, as means for estimating a physical quantity related to a motive power of said auxiliary machine, said engine control means includes a first auxiliary machine motive power estimating section, and said auxiliary machine control means includes a second auxiliary machine motive power estimating section, and wherein an estimation precision of an auxiliary machine motive power estimated by said second auxiliary machine motive power estimating section is set higher than an estimation precision of an auxiliary machine motive power estimated by said first auxiliary machine motive power estimating section.

2. A vehicle control system according to claim 1, wherein said engine control means sends an estimation condition to said auxiliary machine control means, and wherein said auxiliary machine control means estimates the auxiliary machine motive power based on the estimation condition by said second auxiliary machine motive power estimating section and sends an estimated value to said engine control means.

3. A vehicle control system according to claim 2, wherein the estimation condition is at least one of a response delay time, an estimation timing, and an estimation precision of the auxiliary machine motive power estimation.

4. A vehicle control system according to claim 3, wherein said engine control means estimates the auxiliary machine motive power by said first auxiliary machine motive power estimating section when said second auxiliary machine motive power estimating section does not satisfy at least one of the estimation conditions.

5. A vehicle control system according to claim 1, further comprising:

an estimated motive power deviation monitoring means configured to calculate a deviation between the auxiliary machine motive powers that are respectively estimated by said first auxiliary machine motive power estimating section and said second auxiliary machine motive power estimating section and to monitor whether the deviation is equal to or larger than a predetermined value, wherein said engine control means estimates the auxiliary machine motive power by said first auxiliary machine motive power estimating section when the deviation becomes equal to or larger than the predetermined value.

6. A vehicle control system according to claim 5, wherein said engine control means judges that said second auxiliary machine motive power estimating section is in failure when the deviation continues for a predetermined time or longer, a predetermined frequency or more, or a predetermined number of times or more.

7. A vehicle control system according to claim 5, wherein said engine control means corrects the auxiliary machine motive power estimated by said second auxiliary machine motive power estimating section when the deviation is larger than a first predetermined value and is smaller than a second predetermined value that is larger than the first predetermined value.

8. A vehicle control system according to claim 5, wherein the deviation is compared under a predetermined condition.

9. A vehicle control system according to claim 1, wherein the estimated motive power is used for at least one of an engine control, a transmission control, and an auxiliary machine control.

10. A vehicle control system according to claim 1, wherein said auxiliary machine is at least one of an airconditioning compressor whose refrigerant discharge rate per one rotation is allowed to be set by an external signal, an airconditioning compressor whose rotation speed is allowed to be set by an external signal, a power generating alternator whose power generation rate is allowed to be set by an external signal, an engine cooling fan whose rotation speed is allowed to be set by an external signal, an engine cooling fan whose air flow rate is allowed to be set by an external signal, a cooling water pump whose rotation speed is allowed to be set by an external signal, a cooling water pump whose water flow rate is allowed to be set by an external signal, an auxiliary water pump for a heater whose rotation speed is allowed to be set by an external signal, and an auxiliary water pump for a heater whose water flow rate is allowed to be set by an external signal.

11. A vehicle control system according to claim 2, further comprising:

an estimated motive power deviation monitoring means configured to calculate a deviation between the auxiliary machine motive powers that are respectively estimated by said first auxiliary machine motive power estimating section and said second auxiliary machine motive power estimating section and to monitor whether the deviation is equal to or larger than a predetermined value, wherein said engine control means estimates the auxiliary machine motive power by said first auxiliary machine motive power estimating section when the deviation becomes equal to or larger than the predetermined value.

12. A vehicle control system according to claim 3, further comprising:

an estimated motive power deviation monitoring means configured to calculate a deviation between the auxiliary machine motive powers that are respectively estimated by said first auxiliary machine motive power estimating section and said second auxiliary machine motive power estimating section and to monitor whether the deviation is equal to or larger than a predetermined value, wherein said engine control means estimates the auxiliary machine motive power by said first auxiliary machine motive power estimating section when the deviation becomes equal to or larger than the predetermined value.

13. A vehicle control system according to claim 4, further comprising:

an estimated motive power deviation monitoring means configured to calculate a deviation between the auxiliary machine motive powers that are respectively estimated by said first auxiliary machine motive power estimating section and said second auxiliary machine motive power estimating section and to monitor whether the deviation is equal to or larger than a predetermined value, wherein said engine control means estimates the auxiliary machine motive power by said first auxiliary machine motive power estimating section when the deviation becomes equal to or larger than the predetermined value.

14. A vehicle control system according to claim 11, wherein said engine control means judges that said second auxiliary machine motive power estimating section is in failure when the deviation continues for a predetermined time or longer, a predetermined frequency or more, or a predetermined number of times or more.

15. A vehicle control system according to claim 12, wherein said engine control means judges that said second auxiliary machine motive power estimating section is in failure when the deviation continues for a predetermined time or longer, a predetermined frequency or more, or a predetermined number of times or more.

16. A vehicle control system according to claim 13, wherein said engine control means judges that said second auxiliary machine motive power estimating section is in failure when the deviation continues for a predetermined time or longer, a predetermined frequency or more, or a predetermined number of times or more.

17. A vehicle control system according to claim 11, wherein said engine control means corrects the auxiliary machine motive power estimated by said second auxiliary machine motive power estimating section when the deviation is larger than a first predetermined value and is smaller than a second predetermined value that is larger than the first predetermined value.

18. A vehicle control system according to claim 12, wherein said engine control means corrects the auxiliary machine motive power estimated by said second auxiliary machine motive power estimating section when the deviation is larger than a first predetermined value and is smaller than a second predetermined value that is larger than the first predetermined value.

19. A vehicle control system according to claim 13, wherein said engine control means corrects the auxiliary machine motive power estimated by said second auxiliary machine motive power estimating section when the deviation is larger than a first predetermined value and is smaller than a second predetermined value that is larger than the first predetermined value.

20. A vehicle control system according to claim 6, wherein said engine control means corrects the auxiliary machine motive power estimated by said second auxiliary machine motive power estimating section when the deviation is larger than a first predetermined value and is smaller than a second predetermined value that is larger than the first predetermined value.

* * * * *